US005363890A

United States Patent [19]

Yeung et al.

[11] Patent Number: 5,363,890

[45] Date of Patent: Nov. 15, 1994

[54] NONSPILL BOTTLED WATER REPLACEMENT SYSTEM WITH DISPOSABLE SEAL MEMBER

[75] Inventors: Michael Yeung, Newark; Robert N. Lee, Palo Alto; Chein-Hwa Tsao, San Jose, all of Calif.

[73] Assignee: Innostar, Inc., San Jose, Calif.

[21] Appl. No.: 13,778

[22] Filed: Feb. 5, 1993

[51] Int. Cl.[5] ..... B65D 47/00

[52] U.S. Cl. ..... 141/364; 141/114; 141/110; 220/256; 215/253; 222/54; 222/213; 222/491; 222/541

[58] Field of Search ..... 141/1, 114, 319, 110–112, 141/363–366; 220/256–258; 215/31, 32, 253; 222/1, 202, 203, 212, 213, 54, 491, 541, 531, 532, 574

[56] References Cited

U.S. PATENT DOCUMENTS

| | | | |
|---|---|---|---|
| 3,118,573 | 1/1964 | Johnson | 222/212 |
| 3,399,806 | 9/1968 | Lucas | 222/54 X |
| 3,952,741 | 4/1976 | Baker | 222/54 X |
| 4,114,653 | 9/1978 | Carlin | 222/54 X |
| 4,121,734 | 10/1978 | Soong et al. | 222/54 |
| 4,696,328 | 9/1987 | Rhodes, Jr. | 141/1 |
| 4,789,082 | 12/1988 | Sampson | 222/1 |
| 4,792,069 | 12/1988 | Nantin et al. | 222/574 X |
| 4,938,390 | 7/1990 | Markva | 222/206 |
| 4,953,729 | 9/1990 | Kloosterhouse | 215/255 |
| 5,014,888 | 5/1991 | Bryan | 222/541 |
| 5,083,675 | 1/1992 | Albanesi | 220/258 X |
| 5,105,986 | 4/1992 | Pham et al. | 222/145 |

*Primary Examiner*—J. Casimer Jacyna
*Attorney, Agent, or Firm*—James J. Leary

[57] ABSTRACT

A device which prevents spillage when a water bottle is inverted for installation onto a water dispenser. The device establishes the flow of water from the water bottle into the water dispenser after a predetermined time delay from when the bottle is inverted. The device is a membrane closure which initially provides a water tight seal on the mouth of the water bottle, but which opens up to allow water to flow from the bottle after a predictable time delay. Thus, the user can slowly and carefully invert the water bottle and place it in the correct position. Three embodiments are presented: 1) a membrane seal which is folded multiple times to create an initially water tight seal, which, when the water bottle is inverted, slowly unfolds due to the hydrostatic pressure, thereby opening the seal and allowing the water to flow; 2) a membrane seal of a moisture sensitive material which is coated with a water impermeable material and which is scored in a desired rupture pattern. When the bottle is inverted, the water penetrates the membrane seal which ruptures, allowing the water to flow after a predictable time delay; 3) a composite membrane seal made of a water impermeable material which has a moisture sensitive material within it, forming a desired rupture pattern. When the bottle is inverted, the water penetrates the moisture sensitive material and weakens it so that it will rupture after a predictable time delay.

5 Claims, 7 Drawing Sheets

NONSPILL BOTTLED WATER REPLACEMENT SYSTEM WITH DISPOSABLE SEAL MEMBER

FIELD OF THE INVENTION

The present invention relates in general to water dispensers of the type which have a water bottle that is inverted and loaded onto a water dispenser. More specifically, it relates to a device which prevents spillage when the water bottle is inverted during installation and which prevents the flow of water from the bottle for a predetermined time delay.

BACKGROUND OF THE INVENTION

Many offices, stores, factories and homes are equipped with drinking water dispensers for their members. While some dispensers are plumbed permanently to a tap water supply, others employ a user replaceable supply, such as an inverted water bottle removably mounted on top of the dispenser. Examples of the design of such dispensers are U.S. Pat. No. 3,698,603 issued October 1972 to Radcliffe and U.S. Pat. No. 4,664,349 issued May 1987 to Johansen.

One of the primary difficulties with such prior art dispenser systems employing an inverted bottle lies in the procedure of user replacement of a used bottle. At this time, a nearby full bottle has to be substituted in its place. Typically the bottles are of 5 gallon capacity and therefore very heavy. This means that, after the user removes the used bottle and opens the cap of the full bottle, the user would have to lift the full bottle and, in one very quick movement, invert it and insert its neck accurately into the intake opening on top of the dispenser and maneuver the body of the bottle into vertical position for normal operation. Any less than good execution of this exceptionally demanding procedure will result in excessive water spillage plus possible personal injury. In any case, the current procedure always wastes some water through unavoidable spillage, in addition to being dangerous to the user.

Two prior patents taught the idea of, upon loading of the full container, piercing an otherwise sealing member of the container thus establishing either the flow of one single fluid or the simultaneous flow of two different fluids from the supply bottle. The piercing element being a permanent part of the dispenser. These are U.S. Pat. No. 1,248,704 issued October 1916 to Pogue and U.S. Pat. No. 4,676,775 issued June 1987 to Zolnierczyk, et al. But the implementation of these methods would require the modification of the existing dispensers and bottles which is undesirable.

OBJECTIVES AND SUMMARY OF THE INVENTION

A principal objective of the present invention is to provide a device which prevents spillage when a water bottle is inverted for installation onto a water dispenser. It is also an objective that the device should establish the flow of water from the water bottle into the water cooler after a predetermined time delay from when the bottle is inverted. It is preferable that the water flow be established without further intervention from the user. It is also preferable that the device be buildable from low cost materials so that it does not add significantly to the cost of the water bottle and so that it can be made disposable if desired. The device should also be buildable from recyclable materials. Another objective of the invention is to provide the device in embodiments which are suitable for automated installation by the water bottling company and for hand application by the end user.

Accordingly, the present invention takes the form of a membrane closure which initially provides a water tight seal on the mouth of the water bottle, but which opens up to allow water to flow from the bottle after a predictable time delay. The first embodiment has a membrane seal which is folded multiple times to create an initially water tight seal. When the water bottle is inverted, the membrane seal slowly unfolds due to the hydrostatic pressure, thereby opening the seal and allowing the water to flow. The second embodiment has a membrane seal of a moisture sensitive material which is coated with,a water impermeable material. The membrane is creased or scored in a desired rupture pattern which weakens the membrane and breaks the water impermeable coating along the creases. When the bottle is inverted, the water penetrates the membrane seal along the creases and weakens the moisture sensitive material which ruptures, allowing the water to flow after a predictable time delay. The third embodiment has a membrane seal made of a water impermeable material which has a moisture sensitive material within it, forming a desired rupture pattern. When the bottle is inverted, the water penetrates the moisture sensitive material and weakens it so that it will rupture after a predictable time delay. Any of the embodiments of the invention may be used in combination with the tear-away plastic caps currently used for water bottles. The membrane provides a hermetic sanitary seal under the plastic cap.

The invention allows the user to install a full water bottle onto a water dispenser without any danger of spilling. Thus, the user can slowly and carefully invert the water bottle and place it in the correct position. This is much easier and safer than the current practice, which requires speed, strength and coordination to quickly invert the unsealed bottle and place it on the water dispenser before the water gushes out. Other objects and advantages of the invention will become apparent from reading and understanding the accompanying drawings.

DETAILED DESCRIPTION OF THE PREFERRED EMBODIMENTS

Figure 2:
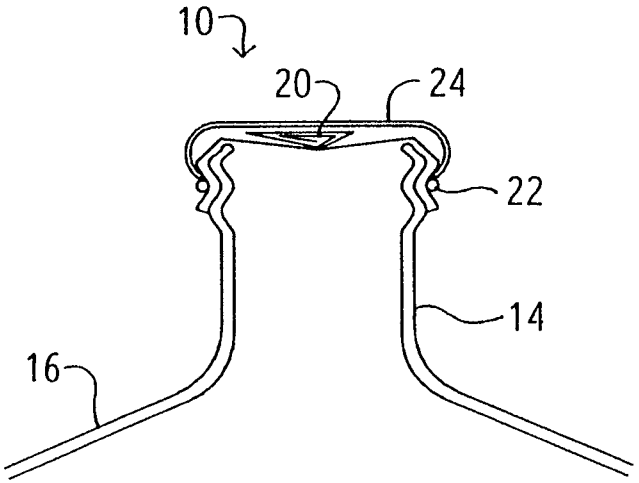
FIG. 2 shows a cross section of the folded membrane closure sealed beneath a tear-away plastic cap.
Figure 1A:
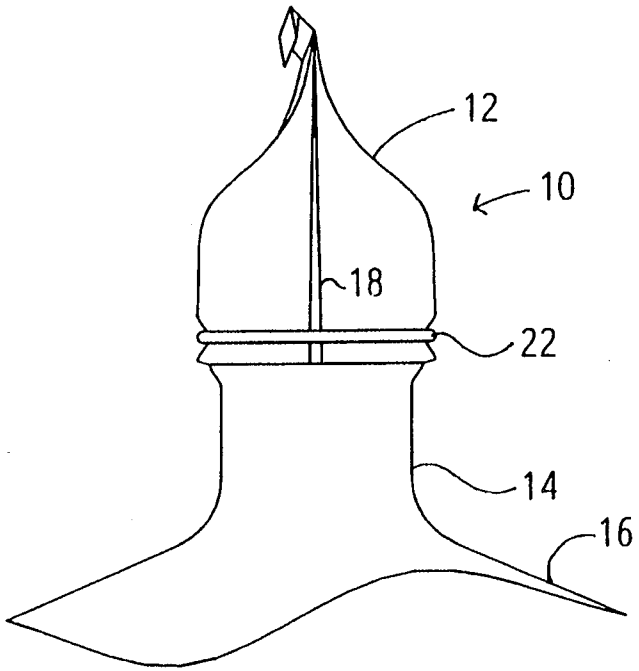
FIG. 1A shows a folded membrane closure as it is being formed.

FIG. 1A shows a folded membrane closure 10 as it is being formed. The membrane 12 can be made of almost any thin, flexible water-impermeable material, such as paper, waxed paper, plastic or aluminum foil, aluminum foil being the preferred material. To form the folded membrane closure 10, the membrane 12 is first formed into a tube of approximately the same diameter as the neck 14 of the water bottle 16. The membrane 12 may be formed as a continuous tube, as by plastic extrusion, or a flat sheet of membrane material 12 may be wrapped into a tube and the edges 18 folded together or otherwise sealed to form a tube. Next, the tube is flattened out and the flattened tube is folded repeatedly. The folds may be made in a zig-zag pattern or folded repeatedly in one direction to form a roll 20 of membrane material which lays flat against the neck 14 of the bottle as shown in FIG. 2.

The folded membrane seal 10 may be formed directly on the neck of the bottle, or it may be formed separately and later attached to the bottle neck 14. The membrane 12 can be attached to the bottle neck 14 by gluing, attaching with an elastic band 22 or attaching with a ring of heat shrink material. Once the folded membrane seal 10 is attached, the bottle neck 14 can be covered with a cap 24 which may be a tear-away plastic cap like those in current use.

Figure 1C:
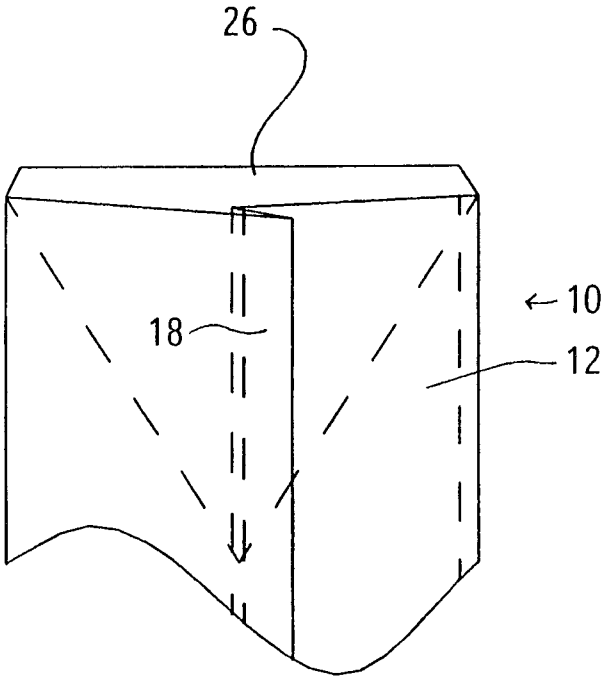
FIG. 1B and 1C are detail drawings of the membrane folding procedure.
Figure 1B:
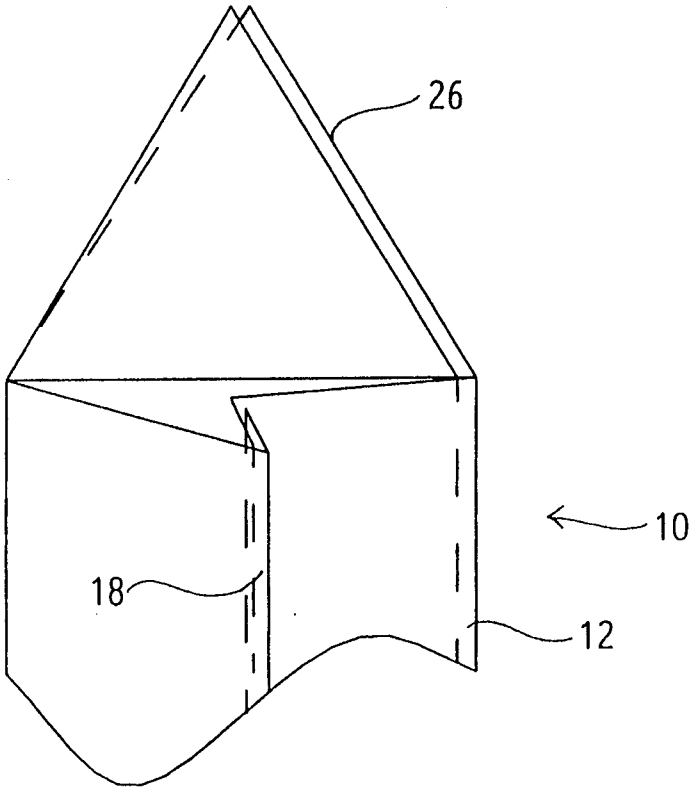
Figure 3B:
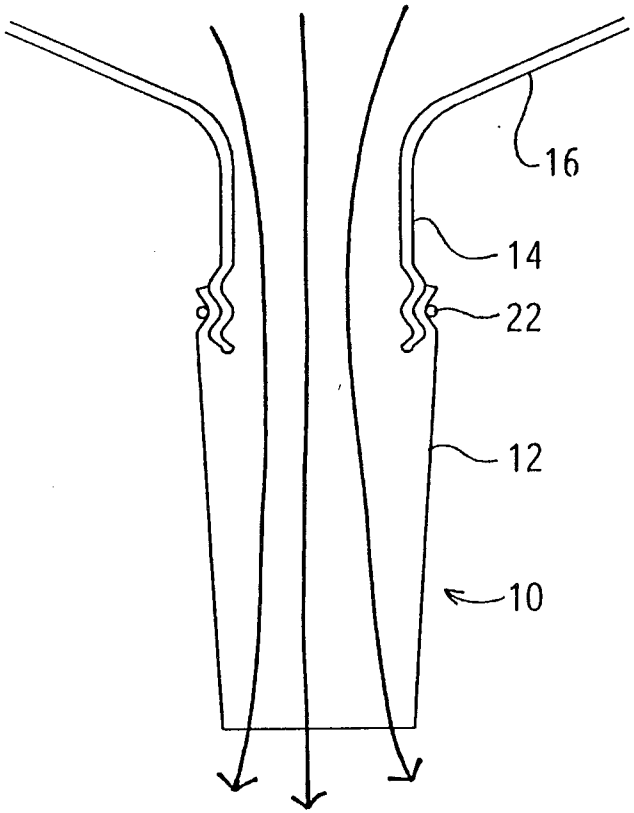
FIGS. 3A & 3B show the folded membrane closure unfolding to release the water from the bottle.
Figure 3A:
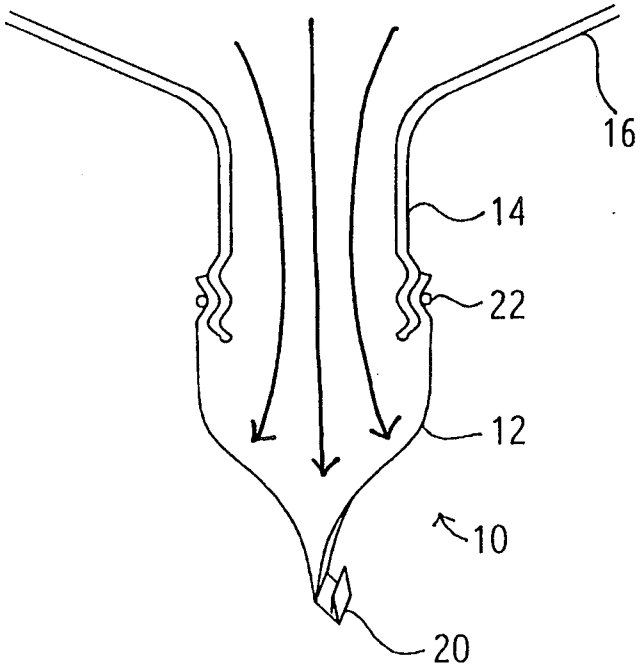

When it is time to change the water bottle 16, the user first removes the plastic cap 24. Then the user lifts the water bottle 16, inverts it and places it on the water dispenser. When the bottle is inverted, the folded seal 10 starts to unfold as shown in FIG. 3A and continues to unfold until it releases the water flow after a brief time delay as shown in FIG. 3B. For most people, inverting and placing the bottle takes from two to five seconds. The time delay provided by the folded seal 10 depends on the length of the membrane 12, the number and pattern of the folds and the stiffness of the membrane material 12. The time delay can be tailored to fall within a predetermined range by proper selection of the material and the folding pattern. A variation on the membrane folding pattern which can be used to somewhat increase the delay time is shown in FIGS. 1B and 1C. The membrane material 12 is precut to have one or more tabs 26 extending from the end of the membrane 12 when it is formed into a tube as shown in FIG. 1B. The tab or tabs 26 are then folded and tucked inside of the tube formed by the membrane 12 as shown in FIG. 1C and the folding is completed as described above in connection with FIG. 1A.

If a greater time delay is desired, the folded membrane seal 10 can be modified by adding a weak adhesive in between the folds that will release under hydrostatic pressure, but will slow the unfolding process. Other ways of increasing the time delay include heat setting the membrane 12 in the folded condition to create a memory in the material which resists unfolding, and embossing the material with a pattern that increases the stiffness of the membrane or causes a temporary adhesion between the sides of the membrane.

Figure 4:
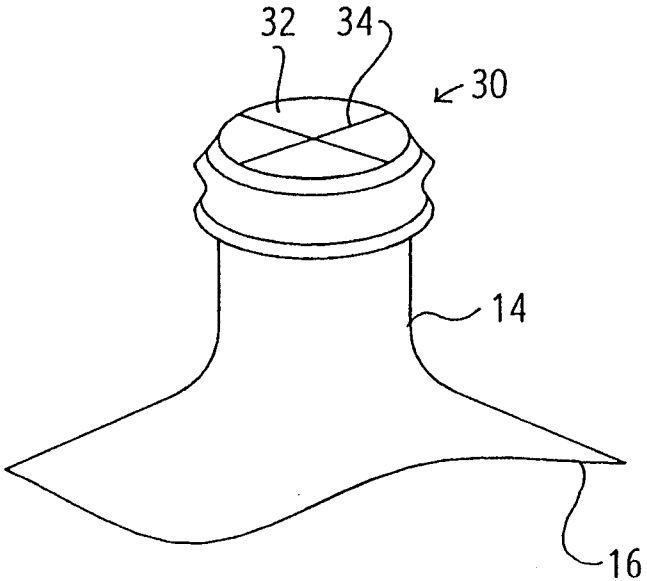
FIG. 4 shows a creased moisture sensitive membrane closure with a water impermeable coating.

FIG. 4 shows a second embodiment of the present invention. In this embodiment the membrane seal 30 is made from a moisture sensitive material which is coated with a water impermeable material.

The moisture sensitive material can be paper or another material which weakens when it absorbs water. The water impermeable material can be wax, shellac, varnish or plastic. The impermeable coating should be applied to at least one side of the moisture sensitive material. Wax coated paper, such as Waxtex microwavable waxed paper made by the Menominee Paper Co. has been found to be a suitable membrane material.

To make the rupturable membrane seal 30, the membrane material 32 is creased or scored in a desired rupture pattern 34 which weakens the material and breaks the water impermeable coating along the creases or scores. The membrane 32 is then placed with the coated side down on the bottle neck 14 and attached by gluing, with an elastic band or with a ring of heat shrink material. It is important that the membrane 32 be attached taut and leak proof across the neck of the bottle 14.

Figure 5:
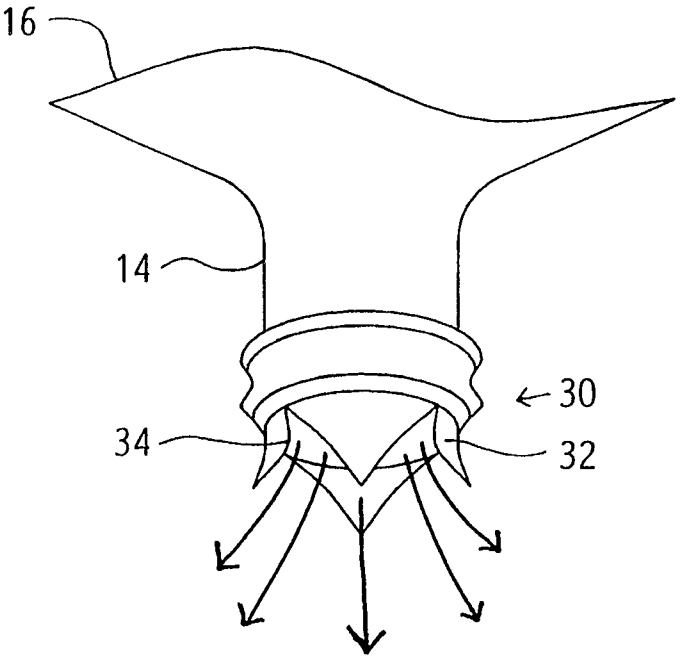
FIG. 5 shows the moisture sensitive membrane rupturing to release water from the bottle.

When the bottle 16 is inverted, water penetrates the moisture sensitive material and begins to weaken it. After a few seconds of delay time, the membrane 32 bursts along the weakened rupture pattern 34 as shown in FIG. 5. The delay time can be varied by changes in the composition or thickness of the moisture sensitive material and by the rupture pattern. The rupturable membrane seal 30 should be covered with a protective plastic cap to prevent premature rupture in case the bottle 16 is tipped or inverted during storage or transport.

Figure 7:
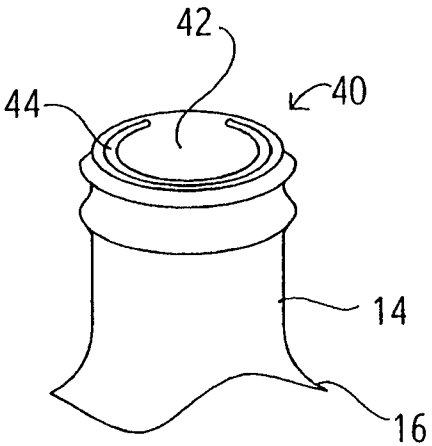
FIG. 7 shows a perspective view from the top of the composite closure.
Figure 6:
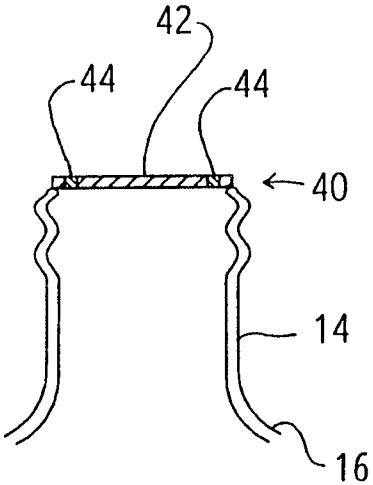
FIG. 6 shows a cross section of a composite closure having an impermeable membrane closure with a moisture sensitive material forming a rupture pattern within the membrane.

FIG. 6 shows a cross section of a third embodiment of the invention. This embodiment is a composite membrane closure 40 which has a water-impermeable membrane 42 that has a moisture sensitive material 44 that forms a preferred rupture pattern within the membrane. The moisture sensitive material 44 can be paper or another material which weakens when it absorbs water. The water-impermeable membrane material 42 can be plastic, wax paper, aluminum foil or any other thin, flexible water impermeable material. The composite membrane 40 is made with the moisture sensitive material 44 in a C-shape as shown in FIG. 7, in an X-shape as in the previous embodiment or any other desired rupture pattern. The composite membrane 40 is attached to the bottle neck 14 with glue, with an elastic band or with a ring of heat shrinkable material to form a hermetic, sanitary seal.

Figure 8:
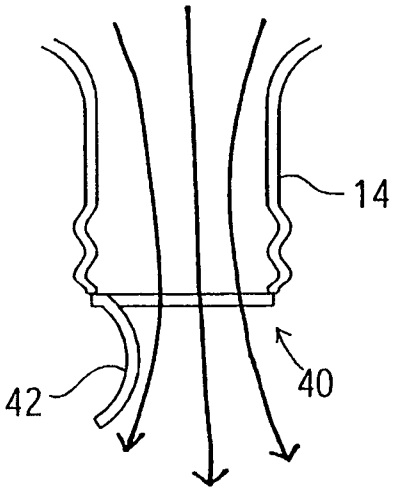
FIG. 8 shows the composite closure rupturing to release water from the bottle.

When the bottle 16 is inverted, water penetrates the moisture sensitive material 44 and begins to weaken it. After a few seconds of delay time the membrane 40 bursts along the weakened rupture pattern releasing the water inside the bottle as shown in FIG. 8. The composite membrane 40 can be covered with a plastic cap (not shown) to prevent premature release of the closure in case the bottle is tipped or inverted during storage or transport.

Figure 9:
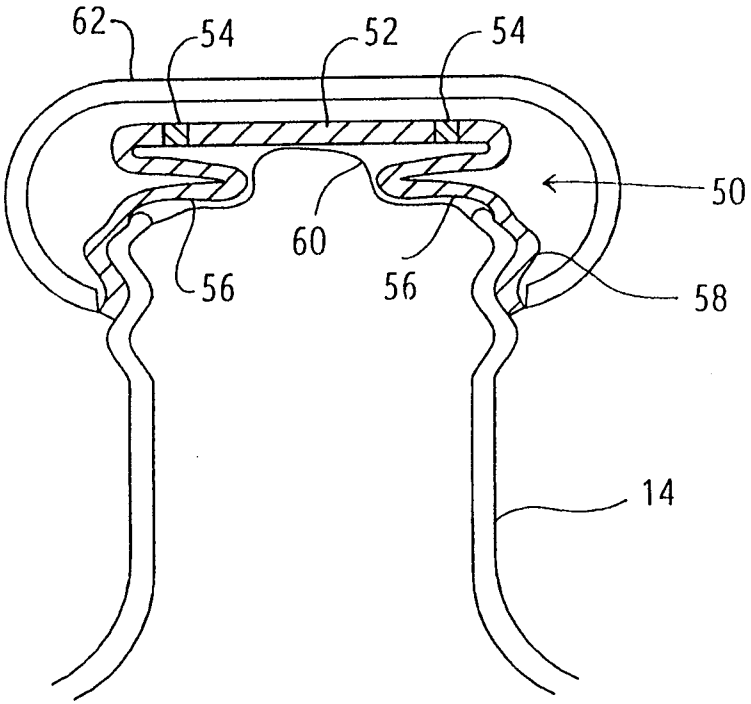
FIG. 9 shows a cross section of a composite closure combined with a frangible water-impermeable membrane.

FIG. 9 shows another manifestation of the third embodiment. In this variant, the composite membrane 50 has a skirt 58 which connects the water-impermeable membrane 52, having a moisture sensitive rupture pattern 54, to the bottle neck 14. The skirt 58, which may be an extension of the impermeable membrane material 52, has at least one accordion fold 56 in it. The composite membrane 50 is lined with a frangible, water-impermeable membrane 60 which protects the composite membrane 50 from water contact during storage or transport. The frangible membrane 60 should be a very thin material which has very little structural strength, but which is water-impermeable. This material can be a very thin film or coating of plastic or wax. The composite membrane 50 should be covered with a tightly fitting plastic cap 62 during shipping and storage.

Figure 10:
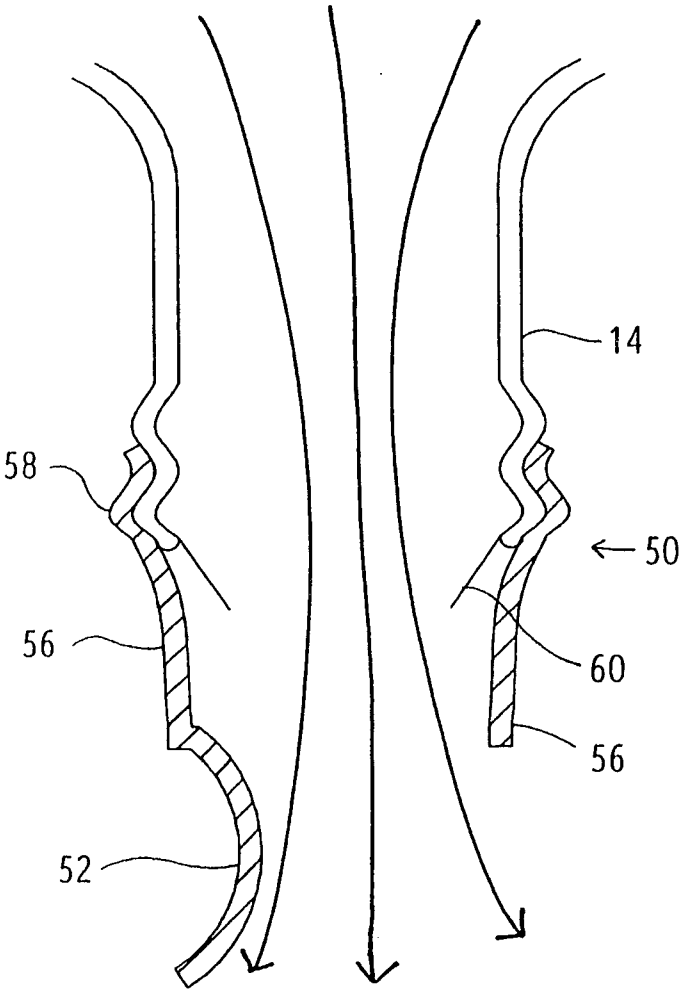
FIG. 10 shows the composite closure and the frangible membrane rupturing to release water from the bottle.

When it is time to install a full water bottle, the user first removes the plastic cap 62, then lifts the bottle, inverts it and places it onto the water cooler. When the bottle is inverted, the hydrostatic pressure expands the frangible membrane 60 and bursts it. Because of the accordion fold 56, the composite membrane 50 lends no support to the frangible membrane 60 which would inhibit it from bursting. Once the frangible membrane 60 is broken, the water contacts the composite membrane 50 and begins to penetrate the moisture sensitive material 54 and weaken it. After a few seconds of delay time the composite membrane 50 ruptures and the water flows out as shown in FIG. 10.

All of the embodiments of the present invention are suitable for application by automated bottling equipment by the water bottling company. They can also be applied by hand to the water bottles by the end user. The membrane closures may be individually wrapped in sanitary packages. The closure may have an adhesive strip, or a prestreched elastic band which is deployed by pulling a string, to attach the closure to the neck of the bottle. Later, when the water bottle is empty, the material of the closure can be discarded or it can be recycled to reduce material waste.

Figure 12:
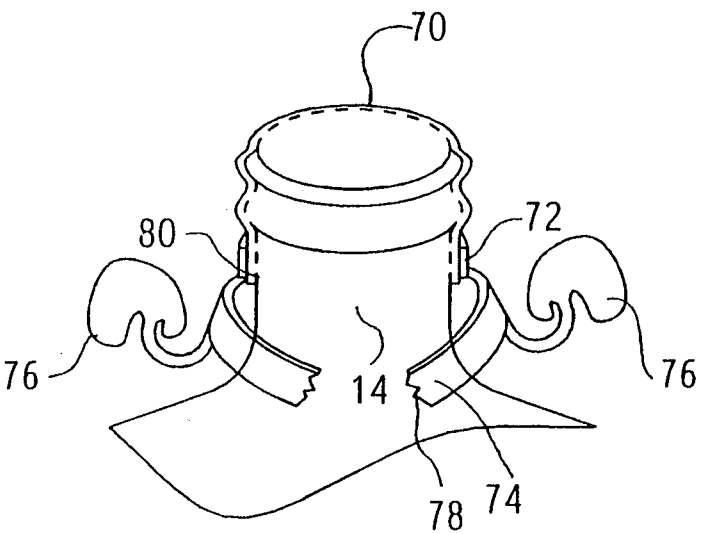
FIG. 12 shows the completion of the membrane closure installation procedure.
Figure 11:
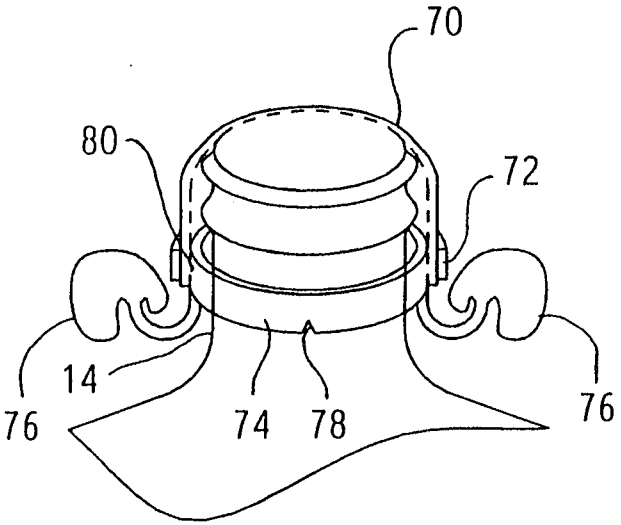
FIG. 11 shows the membrane closure being installed on the neck of a water bottle.

FIGS. 11 and 12 show a convenient method for applying the membrane closures 70 to the neck of a water bottle 14 by hand. The membrane closure 70, which can be any of the above-described embodiments, is provided with a skirt 80, which may be an extension of the membrane material 70. The skirt 80 surrounds a support ring 74 which is used to support a prestretched elastic band 72. For convenience to the user, the support ring 74 is provided with pull tabs 76 for grasping the ring 74 and one or more notches 78 to aid in separating the ring 74. To install the membrane closure onto the bottle neck 14, the closure 70 and the support ring 74 are lowered over the bottle neck 14, as shown in FIG. 11. Then the support ring 74 is split apart at the notches 78 by pulling on the pull tabs 76, which releases the elastic band 72, holding the skirt 80 of the closure 70 tightly onto the bottle neck 14, as shown in FIG. 12. For complete sanitation, the closure 70 and the support ring 74 may be supplied individually packaged with a top and bottom sanitary seal. During application, the user first peels off the bottom seal and mounts the closure on the bottle as just described. The final step before the bottle is inverted is to peel off the top seal to expose the membrane closure 70.

Although the examples given include many specificities, they are intended as illustrative of only some of the possible embodiments of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

What is claimed is:

1. For use with a water bottle which, when installed in a water cooler, is placed in an inverted position over an opening in the water cooler tank, a device for controlling the flow of water from an opening in the water bottle comprising:

a membrane closure sealingly attached to said opening in said water bottle, said membrane closure being formed of a water-impermeable material and a moisture-sensitive material which forms a preferred rupture pattern within said water-impermeable material, said membrane closure initially providing a water tight seal to said opening in said water bottle when said bottle is stored in an upright position, when said bottle is inverted for installation, water penetrates said moisture-sensitive material within said water-impermeable material, thereby weakening said membrane closure such that said membrane closure ruptures after a time delay releasing the water through said opening in said bottle, a water-impermeable frangible membrane liner which protects said membrane closure from contacting the water inside said water bottle when said bottle is stored, and, when said bottle is inverted for installation, said frangible membrane liner ruptures allowing the water inside said bottle to contact said membrane closure, and at least one fold in said membrane closure which allows said membrane closure to expand under hydrostatic pressure when said water bottle is inverted thereby causing said frangible membrane liner to rupture allowing the water inside said bottle to contact said membrane closure.

2. The device of claim 1 wherein said moisture-sensitive material is paper which weakens upon absorption of water and said water-impermeable material is selected from the group consisting of wax, aluminum foil and plastic.

3. The device of claim 1 wherein said preferred rupture pattern within said water-impermeable material is formed in the shape of a C such that said membrane closure ruptures to form an opening with flap which remains attached to said bottle.

4. The device of claim 1 further comprising a removable protective cap, said protective cap covering said membrane closure and said frangible membrane liner, said protective cap preventing said membrane closure from expanding until said protective cap is removed.

5. The device of claim 1 wherein said preferred rupture pattern within said water-impermeable material is formed in the shape of an X such that said membrane closure ruptures to form an opening with four flaps which remains attached to said bottle.

* * * * *